US011684142B2

(12) United States Patent
Ezell

(10) Patent No.: US 11,684,142 B2
(45) Date of Patent: Jun. 27, 2023

(54) DISPOSABLE TOOTHBRUSH HEAD

(71) Applicant: Anne Ezell, Tucson, AZ (US)

(72) Inventor: Anne Ezell, Tucson, AZ (US)

( * ) Notice: Subject to any disclaimer, the term of this patent is extended or adjusted under 35 U.S.C. 154(b) by 126 days.

(21) Appl. No.: 17/029,484

(22) Filed: Sep. 23, 2020

(65) Prior Publication Data

US 2021/0259400 A1 Aug. 26, 2021

Related U.S. Application Data

(60) Provisional application No. 62/979,272, filed on Feb. 20, 2020.

(51) Int. Cl.
*A46B 5/04* (2006.01)
*A46B 9/04* (2006.01)

(52) U.S. Cl.
CPC ..... *A46B 5/04* (2013.01); *A46B 9/04* (2013.01); *A46B 2200/1066* (2013.01)

(58) Field of Classification Search
CPC ..... A46B 11/0003; A46B 2200/01; A46B 2200/1066; A46B 9/04; A46B 5/04
USPC ..... 15/167.1
See application file for complete search history.

(56) References Cited

U.S. PATENT DOCUMENTS 1,168,998 A * 1/1916 Brandenburg ..... 2/21
2,075,681 A * 3/1937 Welker ..... A46B 11/0003 401/7
2,121,701 A * 6/1938 Landers ..... A46B 17/04 601/139
2,921,590 A * 1/1960 Holton ..... A46B 5/04 401/118
3,105,260 A * 10/1963 Smith ..... A46B 5/04 15/187
3,368,668 A * 2/1968 Micciche ..... A46B 5/04 206/229
3,678,528 A * 7/1972 Haije ..... A46B 17/02 132/308
3,722,020 A * 3/1973 Hills ..... A46B 9/045 15/167.1
3,798,698 A * 3/1974 Conklin, Jr. ..... A46B 5/04 15/167.1
5,181,531 A * 1/1993 Escoto ..... G07F 11/72 132/308

(Continued)

FOREIGN PATENT DOCUMENTS

FR 2591082 A1 * 6/1987
JP 2005318911 A * 11/2005
JP 2007244546 A * 9/2007

*Primary Examiner* — Don M Anderson
*Assistant Examiner* — Jason Khalil Hawkins
(74) *Attorney, Agent, or Firm* — Brennan, Manna & Diamond, LLC

(57) ABSTRACT

This present application discloses a disposable toothbrush head product that cleans the teeth and removes plaque, food particles and other unwanted debris from the mouth easily and safely. The disposable toothbrush head product is an individually wrapped, thin plastic or rubber toothbrush head with a series of shorter bristles. The bristles are coated with an activatable toothpaste, gel or other tooth cleaning solution. The brush head can be adhered to a finger using adhesive or a plastic ring for cleaning the teeth. Additionally, the product is a convenient toothbrush option for individuals looking to clean teeth while away from home.

6 Claims, 3 Drawing Sheets

(56) References Cited

U.S. PATENT DOCUMENTS

| | | | | | |
|---|---|---|---|---|---|
| 5,213,428 | A * | 5/1993 | Salman | A46B 15/0071 | D30/158 |
| 5,287,584 | A * | 2/1994 | Skinner | A46B 5/04 | 2/21 |
| 5,605,756 | A * | 2/1997 | Sanduja | A61K 8/02 | 428/394 |
| 5,678,273 | A * | 10/1997 | Porcelli | A46B 5/06 | 15/207.2 |
| 5,794,774 | A * | 8/1998 | Porcelli | A46B 11/0003 | 206/369 |
| 5,911,319 | A * | 6/1999 | Porcelli | B65D 85/671 | 206/63.5 |
| 6,116,252 | A * | 9/2000 | Stelmach | A46B 5/04 | 132/309 |
| 7,234,192 | B2 * | 6/2007 | Barbar | A46B 5/04 | 206/362.2 |
| 9,095,205 | B2 * | 8/2015 | Stofko | A46B 9/04 | |
| 9,700,127 | B2 * | 7/2017 | Wagstaff | A46B 9/06 | |
| 2003/0213082 | A1 * | 11/2003 | Tanaka | A46B 5/04 | 15/227 |
| 2004/0022576 | A1 * | 2/2004 | Hoyle | A46B 11/0079 | 401/172 |
| 2008/0282487 | A1 * | 11/2008 | Porcelli | A46B 5/04 | 15/104.94 |
| 2010/0306941 | A1 * | 12/2010 | Erskine-Smith | A46B 9/026 | 15/167.1 |
| 2016/0302565 | A1 * | 10/2016 | Jimenez | A46B 7/04 | |
| 2018/0360204 | A1 * | 12/2018 | Xi | A46D 1/0238 | |

* cited by examiner

DISPOSABLE TOOTHBRUSH HEAD

CROSS-REFERENCE TO RELATED APPLICATION

The present application claims priority to, and the benefit of, U.S. Provisional Application No. 62/979,272, which was filed on Feb. 20, 2020 and is incorporated herein by reference in its entirety.

BACKGROUND OF THE INVENTION

The present invention relates to the field of oral hygiene appliances, and particularly to a toothbrush product. More specifically, the present invention relates to a disposable toothbrush head having bristles which are shorter than normal bristles and that are coated in toothpaste to provide a convenient toothbrushing option for individuals to clean their teeth while away from home and to always maintain adequate teeth freshening or cleansing. The disposable toothbrush head product is individually wrapped (but doesn't have to be), measures approximately 2" long by 1" wide, and can be adhered or applied to a finger of a user using adhesive or a plastic ring during use. Accordingly, the present specification makes specific reference thereto. However, it is to be appreciated that aspects of the present invention are also equally amenable to other similar applications, devices and methods of manufacture.

By way of background, toothbrushes are indispensable and are used not only at home and at work, but also during business and leisure travel. Toothbrushes commonly used in homes are designed to be continually used as long as the bristles are not damaged, or as otherwise recommended by the manufacturer. Disposable hygiene appliances are usually discarded after being used for a brief duration, such as during business or leisure travel. A conventional toothbrush has a handle and an integrally formed head portion, and is used to clean the user's teeth by removing plaque, food and other debris from and between the surfaces of the teeth as well as from the gums. The handle is provided for the user to readily grasp and manipulate the toothbrush, and may be formed of many different shapes and with a variety of constructions. The head portion is disposed on an end portion of the toothbrush support or handle, and is provided with tooth cleaning elements known as bristles. The tooth cleaning elements are attached to a base surface of the head portion, and extend outwardly therefrom.

Furthermore, conventional toothbrushes are used for cleaning teeth using toothpaste or other cleaning/polishing solutions that are typically applied to the toothbrush just prior to brushing. More specifically, and by way of example, a predetermined amount of toothpaste from a tube containing toothpaste is squeezed, and is applied to the cleaning elements or bristles of the toothbrush head portion. Even disposable toothbrushes known in the art contain a handle and a head to clean the teeth and are to be used with a toothpaste tube. Therefore, in order to brush the teeth using a conventional toothbrush, a toothpaste tube together with the toothbrush is to be provided, thus causing the problem of having to transport and locate both items (as one is typically not of use without the presence of the other), in particular when traveling or when one is away from home or when getting ready for an appointment with, for example, a dentist. Stated differently, carrying both an elongated toothbrush and the elongated toothpaste tube together is an inconvenience and one or both can easily be misplaced while travelling. Further, carrying of one or both items in a wallet or small pocket is generally not feasible.

Additionally, hygiene management of both the teeth and gums is important, and if dental hygiene is not continuously maintained, tooth or gum damage may occur from, for example, the presence of decaying food particles, bacteria, germs and the like. If damaged, dental treatment is necessary and, in some cases, implants or prostheses are required, which are both expensive and may be painful for the user. While one can brush their teeth at a remote location, many individuals may not be comfortable with using a traditional elongated and bulky toothbrush in a public setting. Also, as stated above, if a user carries the toothbrush for travel but forgets the toothpaste tube, the toothbrush alone is not as effective and the accompanying toothpaste may not be otherwise readily available to the user. Further, while other existing products, such as toothpicks and floss, are also used to maintain dental hygiene during travel or periods away from home, such products do not achieve the same results as a toothbrush with toothpaste combination.

It is also worth noting that with respect to currently available disposable toothbrush products, the handle must be present in order to utilize the toothbrush. Further, most toothbrush handles are elongated and permanently connected to the toothbrush head, as the two are molded together, which is cumbersome and inconvenient for the user to carry along especially when the user does not carry a bag, such as a luggage bag or purse. Further, a user traveling for an extended period of time may need to carry multiple disposable toothbrushes, which may occupy valuable space in the user's travel bag. Some electric or battery powered toothbrushes have a removable head thereby shortening the overall length of the device and making it easier to transport, but such devices also require a battery, driver and/or charger that also have to be transported. Carrying multiple separate toothbrushes is both cumbersome and inconvenient, and the battery unit typically must be packed in the user's luggage due to current airport screening regulations. Accordingly, a disposable toothbrush head product is desired which can be used without a handle to clean the user's teeth on the go, and to overcome the disadvantages associated with conventional toothbrush products. Consumers of disposable toothbrushes for cleaning teeth also desire a disposable toothbrush head with pre-applied toothpaste that can be conveniently carried in a purse, pocket, or wallet for use away from home, and that enables consumers to achieve a quick cleansing and freshening while on the go.

Therefore, there exists a long felt need in the art for a disposable toothbrush product that easily, efficiently and effectively cleans plaque, food particles and other debris from the user's teeth, thereby promoting dental hygiene. There is also a long felt need in the art for a disposable toothbrush product that has a structure that easily conforms to the shape of the user's teeth, and that easily moves over said teeth and the gum line while brushing so as to not damage the surface of the teeth or the user's gums. Additionally, there is a long felt need in the art for a toothbrush product that is disposable, used without a toothbrush handle (therefore, compact), and is an integral, one piece structure that is inexpensive to manufacture and purchase. Moreover, there is a long felt need in the art for a disposable toothbrush product with pre-applied tooth paste, thereby eliminating the need to use and transport a separate toothpaste tube. Finally, there is a long felt need in the art for a disposable toothbrush product that can be conveniently carried in a purse, pocket, or wallet for use away from home, and that enables users to achieve a quick cleansing and freshening while on the go.

The subject matter disclosed and claimed herein, in one embodiment thereof, comprises a disposable toothbrush head containing a base with an adhesive strip or a finger ring on one side of the base which allows the head to be removably adhered or attached to a user's finger. The head contains bristles that are coated with toothpaste to make the disposable toothbrush head readily capable of being used by an individual to effectively and easily clean the teeth to remove plaque, food particles and other debris while on the go, and without the need for separate tooth paste. More specifically, the disposable toothbrush head of the present invention allows the user to simply use the head without much inconvenience and without the need for an extended handle portion, which may be bulky and difficult to transport. Additionally, the disposable toothbrush head is also aesthetically pleasing and cost effective, as well as being safe for the user.

In this manner, the disposable toothbrush head of the present invention accomplishes all of the forgoing objectives, and provides a relatively convenient, easy and cost-effective solution to cleaning teeth and removing plaque and other debris from the user's teeth and gums. The disposable toothbrush head of the present invention is also user friendly inasmuch as it is disposable, less expensive to manufacture and purchase, may be conveniently carried in a pocket, purse or a wallet, and does not require the user to carry a separate toothpaste tube. The disposable toothbrush head of the present invention has a base that contains a tape, an adhesive or a finger ring to adhere or attach the head to the user's finger for use. The head has bristles shorter in size than normal bristles of a toothbrush, and that are pre-coated or treated with a toothpaste or gel. Finally, the disposable toothbrush head product may be marketed as an individually wrapped head with a cover wherein the toothpaste is coated or applied on the bristles before the wrapping is supplied so as to seal the same in an airtight arrangement and protect the same from contamination. The disposable toothbrush head product may be also marketed as multiple toothbrushes per package.

The disposable toothbrush head of the present invention is hygienic, ergonomic, compact in size, lightweight, easy to carry, easy to use, and can be discarded after a single use by the user. The user may carry the toothbrush head of the present invention for important meetings, or prior to a dental appointment, and for use in restaurants, hospitals, schools, hotels, airports and air travel. The toothbrush head product of the present invention is preferably manufactured and sold with the toothpaste composition pre-applied to the bristles, and with a cover providing an airtight seal and in which the toothpaste does not significantly dissipate over a reasonable shelf life period. The disposable toothbrush head of the present invention can be easily purchased through dentists, drug stores, convenience stores, supermarkets, stationery and vending machines, through on-line retailers and can be distributed for anytime, anywhere use, and does not require water in order to activate the toothpaste or allow for use of the device.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a disposable toothbrush head capable of cleaning teeth and removing plaque, food particles, and other debris from a user's teeth and gums. More specifically, the disposable toothbrush head of the present invention comprises a base having an adhesive strip on an exterior surface of the head which allows the base of the head to be easily and securely adhered or attached to a user's finger. To use the disposable toothbrush head, the user simply removes an adhesive strip cover or release liner from the adhesive strip to expose the adhesive and allow the base to be adhered to the user's finger. Toothbrush bristles are present on an interior surface of the base, wherein the bristles have varying surface patterns and are shorter in height than those bristles present on a conventional toothbrush head. The bristles are coated with toothpaste before being wrapped and enclosed in packaging for sale. In design, the overall contour of the disposable toothbrush head product resembles dimensions of a head of a conventional toothbrush, and is flexible enough to move throughout the mouth to give an effective cleaning of the teeth. As previously stated, the toothbrush head product of the present invention is preferably manufactured and sold with the toothpaste pre-applied to the bristles, and with a cover providing an airtight seal about the bristles and toothpaste to prolong their useful life and prevent contamination. Nonetheless, a user may supplement the amount of toothpaste being applied if an external source of toothpaste is otherwise available for use by the individual.

In yet another embodiment of the present invention, the base of the disposable toothbrush head may have a finger ring on an exterior surface (as opposed to, or in addition to, the adhesive strip) such that the head can be readily adhered to the user's finger. The finger ring may be of a circular or oval shape to fit on the finger of the user in a manner similar to a ring worn by the user. The finger ring may have a diameter as per the standard size of ring diameters, or the ring portion may be adjustable in size. The disposable toothbrush head may be provided in any number of colors and/or flavors of the toothpaste to suit the wants and needs of the user. The bristles may also be provided with breath cleaners or a mouthwash type agent so that in addition to cleaning the teeth and gums, the user may also have fresh breath.

In a still further embodiment of the presently described invention, a disposable toothbrush head is described that includes a base having an exterior surface which may have an expandable ring band to fit onto the finger of the user during the cleaning process. More specifically, the ring band diameter may extend along the length of the exterior surface of the base to give a proper cover to the finger when worn by the user, or may be disposed only along a portion of the surface of the base. Alternatively, the band may be made from two clamps, one rising from each side of the base, which clamp onto the user's finger, thereby permitting a user with larger sized fingers to also use the present invention.

In a still a further embodiment of the presently described invention, a method of using a disposable toothbrush head is provided and includes the initial step of providing a disposable toothbrush head of the present invention. The disposable toothbrush head has soft bristles with a toothpaste coating, a base with an interior surface on which the bristles are fixed and an exterior surface on which a mechanism to adhere or attach the disposable toothbrush head to the finger of the user is provided. Next, the disposable toothbrush head is adhered or attached to the finger of the user, and the head is inserted into the mouth in a manner similar to a conventional toothbrush and is moved around the teeth and gums so that the bristles clean between the teeth and remove unwanted plaque, food particles and other debris, while cleaning both the front and back sides of the teeth, and being gentle on the gums. Further, during use, the flavored toothpaste is immediately activated when brought into contact with normal mouth fluids, i.e., saliva, and is released by the scrubbing action of the bristles against the teeth, thereby imparting a desirable flavor to the teeth and mouth of the user thereof. Then, the head and other debris may be removed and disposed of.

In an exemplary embodiment of the presently described invention, a single use toothbrush head is described and includes a toothbrush head having a length and a width, wherein the length of the head is greater than the width. Further, the toothbrush head has first and second surfaces, wherein the first surface has a plurality of flexible and pliable bristles attached thereto, and the second surface has a finger attachment. A solution for cleaning the user's teeth and gums is pre-applied to the bristles, and the cleaning solution is activated upon exposure to water and/or saliva in the user's mouth.

In a further exemplary embodiment of the presently described invention, a package containing a disposable toothbrush head is described, and includes at least one sealed package enclosure sized and configured to hold a single toothbrush head. A toothbrush head for personal use is provided therein. The toothbrush head has a length that is greater than its width, first and second surfaces, wherein the first surface is comprised of a plurality of flexible and pliable bristles and the second surface is comprised of a finger attachment means in the form of a ring, adhesive strip of other attachment means. A solution is provided on at least some of the bristles with a first set of bristles defining a perimeter of the toothbrush head and a second set of bristles provided in an interior area of the toothbrush head, wherein the first set of bristles are taller or longer than the second set of bristles.

In a still further exemplary embodiment of the presently described invention, an easily portable toothbrush head is presented that comprises a head portion having first and second surfaces, a plurality of a first bristles being disposed around a perimeter of the first surface of the toothbrush head and a plurality of a second bristles provided in an interior area of the first surface, wherein the first and second pluralities of bristles are of differing sizes. The toothbrush head further includes a finger engagement provided on the second surface of the toothbrush head, opposite the first surface, for securely and removably holding the toothbrush head on a finger. The finger engagement is provided generally centrally of the toothbrush head. One of an activatable toothpaste, gel or teeth cleaning solution is further provided on each of the first and second plurality of bristles.

It is a further object of the present invention to provide a disposable toothbrush head which is coated with an amount of toothpaste sufficient for a single tooth brushing operation such that the toothbrush head may be disposed of after initial use. It is another object of the invention to provide a method of manufacture of a disposable toothbrush head and toothpaste product with a long-lasting, pleasant and stabilized flavor.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
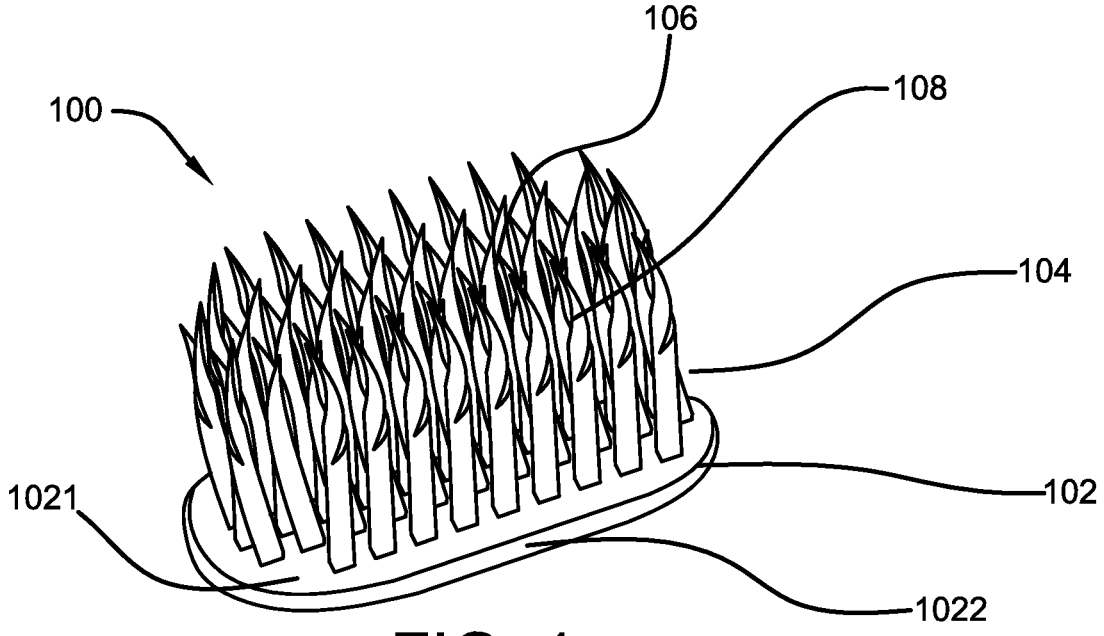
FIG. 1 illustrates a perspective view of one potential embodiment of the disposable toothbrush head product of the present invention having an adhesive backing in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As noted above, there exists a long felt need in the art for a disposable toothbrush product that easily, efficiently and effectively cleans plaque, food particles and other debris from the, tongue, teeth and gums of a user. There is also a long felt need in the art for a disposable toothbrush product that has a structure that conforms to the shape of the teeth, is easy to use and also does not damage the user's teeth or gums. Additionally, there is a long felt need in the art for a disposable toothbrush product that is disposable, does not require the presence of an elongated handle portion, is an integral one piece structure, and is inexpensive to manufacture. Moreover, there is a long felt need in the art for a disposable toothbrush product that has toothpaste pre-applied to its bristles, and that does not require a separate toothpaste tube to use the device. Finally, there is a long felt need in the art for disposable toothbrush product that can be conveniently carried in a purse, pocket, or wallet for use while away from home, and that enables users to achieve a quick cleansing and freshening while on the go.

The innovative product of the present invention features a disposable toothbrush head capable of cleaning teeth and gums and removing plaque, food particles and other debris from the user's tongue, teeth and gums. More specifically, the disposable toothbrush head of the present invention has a base with an adhesive strip or attachment ring on an exterior surface, thereby allowing the head to be removably adhered or attached to a user's finger. In an alternate embodiment, a finger ring or band may be attached to the exterior surface for attaching the toothbrush head to the user's finger. Bristles are present on an interior surface of the base, opposite the exterior surface on which the adhesive strip or attachment ring is disposed, and the bristles have varying surface patterns and are generally shorter in height than bristles present on a conventional toothbrush heads. The bristles of the present invention are also coated with a toothpaste gel before being wrapped, sealed or packaged for sale. In design, the overall contour of the disposable toothbrush head product resembles dimensions of the heads of conventional toothbrushes, and is flexible enough to move throughout the mouth to give an effective cleaning of the user's teeth and gums. The toothbrush head product of the present invention is preferably manufactured and sold with the toothpaste or other tooth cleaning solution applied to the bristles, and with a cover providing an airtight seal for the bristles and toothpaste. All of the parts of the toothbrush head are preferably composed of the same synthetic resin or food grade plastic. More specifically, a number of different synthetic resins may be employed including, without limitation, certain polyesters, including for example, polyethylene, polypropylene and one or more of the nylons (such as a nylon material marketed by Dupont®). Notwithstanding, the preferred material for the base is a polypropylene.

Referring initially to the drawings, FIG. 1 illustrates a perspective view of one possible embodiment of the disposable toothbrush head product 100 of the present invention. The disposable toothbrush head product 100 is preferably comprised of a plastic or rubber base material 102 and has an interior surface 1021 and an exterior surface 1022. A explained more fully below, the exterior surface 1022 of the product 100 comprises an adhesive strip, a finger ring, a band or the like for removably attaching the product 100 to a user's finger to clean the user's tongue, teeth and gums. Integrated bristles, including outer bristles 104 and inner bristles 106, extend outwardly from the interior surface 1021 of the base 102. The height of the bristles 104, 106 are preferably shorter than the bristles of a conventional toothbrush, which are about 10-11 mm, and the head product 100 is sized to accommodate most adults, and is approximately 25 mm in length. Nonetheless, other lengths of product 100 may be provided depending on the age of the user. For example, for children aged 0-2 the length is preferably about 15 mm, for children 2-6 the head size is about 19 mm, and for children 6-18 the head size is about 22 mm.

The top portion of the inner bristles 104 are preferably coated with a toothpaste, gel, dental cleaning solution or coating 108, and the coating 108 is immediately activated when brought into contact with normal mouth fluids, i.e., water and saliva and is released by the scrubbing action of the bristles 104, 106 against the user's teeth and gums. The first and second set of bristles 104, 104 may also be provided in different arrangements, such as outer and inner bristles. In a preferred embodiment of the present invention, the toothpaste, gel or coating 108 may be present on the top portion of both the outer bristles 104 and the inner bristles 106. The outer bristles 104 and the inner bristles 106 may also have similar heights or different heights, as per different versions or embodiments of the head product 100. For example, the outer bristles 104 may be 1-3 mm taller than the inner bristles 106 to allow for reaching into crevices between the user's teeth. The base 102 may have also any shape, such as rectangular, oval, elliptical, or the like to provide different versions of the head product 100 to suit user need and/or preference.

In an alternative embodiment, the toothbrush head 100 may measure approximately 2" in length (50 mm) and 1 to ½" (25.4 mm to 12.7 mm) in width, but different dimensions may also be used based on the demands, age and types of the individual user. For example, as referenced above, the size of the toothbrush head 100 for children may be smaller than the head 100 manufactured for an adult. Nonetheless, the length and width of the head 100 preferably has a ratio of 1.5 to 1 to 2.5 to 1.

Furthermore, the toothbrush head 100 may be discarded after a single use, or be reusable if so desired by the user. The toothbrush head 100 of the present invention provides an effective means of cleaning the user's tongue, teeth and gums, and maintaining oral hygiene, for example, after a meal, before a meeting or a date, and without the need to transport a bulky, regular sized toothbrush and separate toothpaste.

Figure 2:
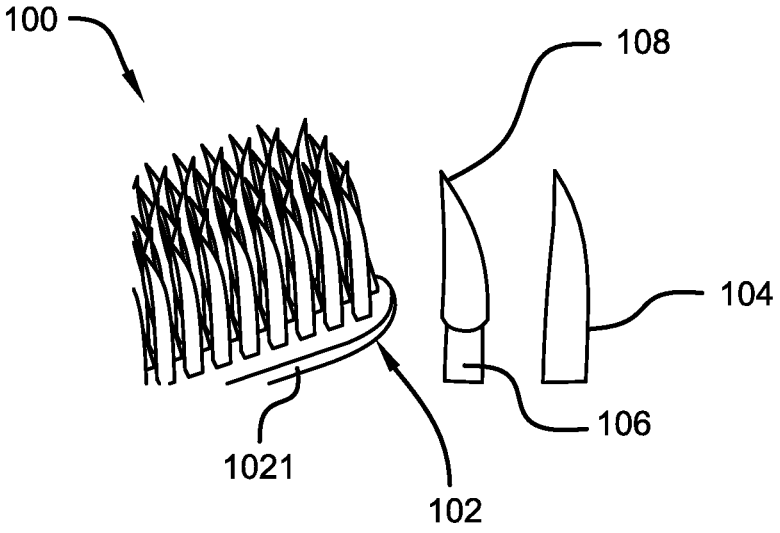
FIG. 2 illustrates a partially exploded view of one potential embodiment of the toothpaste gel coated bristles of the present invention used for cleaning the teeth and removing plaque, food particles and other debris therefrom in accordance with the disclosed structure.

FIG. 2 illustrates a partially exploded view of one potential embodiment of the toothpaste gel coated bristles of the present invention used for cleaning the teeth and gums, and removing plaque, food particles and other debris therefrom in accordance with the disclosed structure. More specifically, the outer bristles 104 and the inner bristles 106 are fixed and extend outwardly from the interior surface 1021 of the toothbrush head base 102. The bristles 104, 106 are relatively soft, pliable and are safe for use in cleaning teeth and gums in accordance with the guidelines of The American Dental Association (ADA). The bristles 104, 106 are also preferably tightly clustered and facilitate the cleaning of hard-to-reach areas of the user's mouth. In one embodiment, the inner bristles 106 have a toothpaste, gel or coating 108 applied on the top portion thereof to help facilitate the cleaning of the teeth and gums during use. The bristles 104, 106 also have rounded, conical or helical tips that will not damage the tooth enamel, and that do not irritate or hurt the user's gums. The bristles 104, 106 may be made of any type of nylon, and preferably Nylon-6 and other eco-friendly materials such as boar, biobased bristles (e.g. castor bean oil, tapioca and corn).

In an alternate embodiment, the outer bristles 104 may also have the toothpaste, gel or coating 108 applied on the top portion thereof to help in cleaning of the user's teeth and gums during use. The bristles 104, 106 of the toothbrush head 100 may also be Crisscross bristles, which are useful in removing surface stains and help to break up plaque between teeth and maintain good oral hygiene. In a further alternative embodiment, the bristles 104, 106 may be charcoal infused bristles, or may be dual action polishing bristles that whiten between the user's teeth. The toothbrush head 100 of the present invention may further comprise multi-level bristles to remove plaque and food from the teeth and gum line to prevent tooth decay.

Figure 3A:
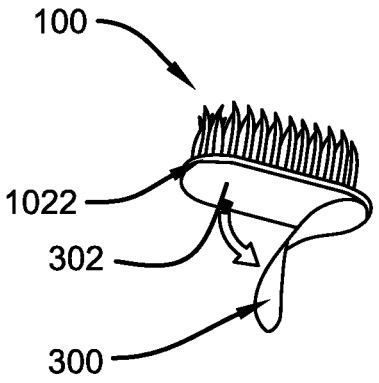
FIG. 3*a* illustrates a perspective view of one potential embodiment of the disposable toothbrush head product of the present invention having an adhesive backing with a releasable liner being peeled off in accordance with the disclosed structure.
Figure 3B:
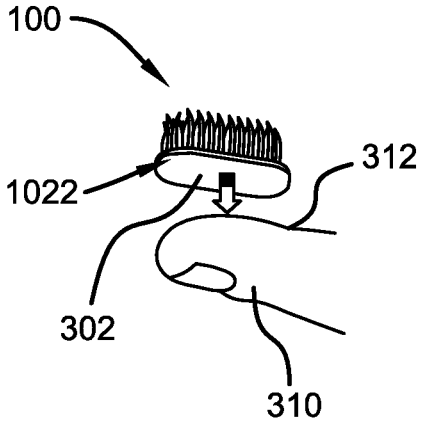
FIG. 3*b* illustrates a perspective view of one potential embodiment of the disposable toothbrush head product of the present invention having an adhesive backing and in the process of being applied to a user's finger in accordance with the disclosed structure.

FIG. 3*a* illustrates a perspective view of one potential embodiment of the disposable toothbrush head product of the present invention having a strip with an adhesive backing 302 with a releasable liner 300 being peeled off in accordance with the disclosed structure. It is contemplated that the toothbrush head 100 may comprise multiple adhesive strips or dots present on an exterior surface 1022 of the base 102. When the toothbrush head 100 is ready to be used by a user for cleaning his or her teeth, the adhesive strip cover 300 is removed completely and easily by a peeling action performed by the user. FIG. 3*b* illustrates a perspective view of one potential embodiment of the disposable toothbrush head product of the present invention having an adhesive backing 302 with the liner 300 already removed, and in the process of being applied to a user's finger in accordance with the disclosed structure. More specifically, the toothbrush head 100 is placed on a fingertip 312 of any finger 310 of the user to adhere the head 100 via the adhesive 302 onto the finger 310. The user's index finger, middle finger, ring finger or pinky finger may be used to facilitate cleaning of the user's teeth. Furthermore, the adhesive material of the strip 302 is pressure sensitive, hypoallergenic and can easily remain stuck to the fingertip 312 even when pressure is being applied during the teeth cleaning process. The adhesive material of the strip 302 is also water-proof, thereby keeping the head 100 fixed to the user's fingertip 312 throughout its use.

Figure 3C:
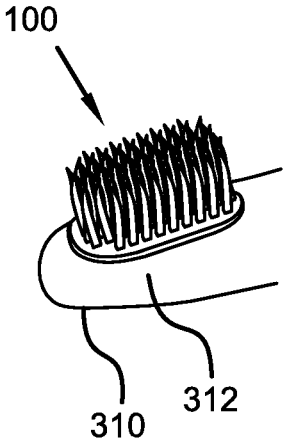
FIG. 3*c* illustrates a perspective view of one potential embodiment of the disposable toothbrush head product of the present invention having an adhesive backing that is releasably secured to a user's finger in accordance with the disclosed structure.

FIG. 3*c* illustrates a perspective view of one potential embodiment of the disposable toothbrush head product of the present invention having an adhesive backing 302 that is releasably secured to a user's finger 310 in accordance with the disclosed structure. As per the embodiment, the adhesive strip 302 is fixed to the exterior surface 1022 of the head toothbrush 100, and has a relatively strong adhesive strength such that the head 100 does not detach from the fingertip 312 during the cleaning process.

Figure 4:
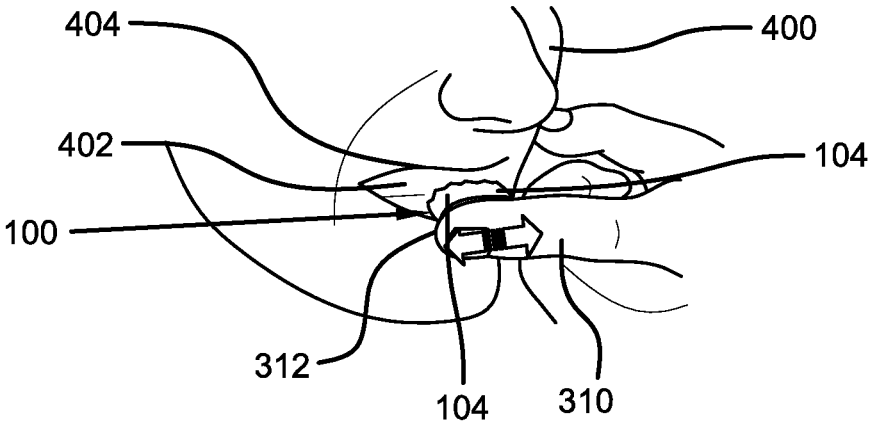
FIG. 4 illustrates a perspective view of one potential embodiment of the disposable toothbrush head product of the present invention attached to a user's finger and being used to clean a user's teeth and gums in accordance with the disclosed structure.

FIG. 4 illustrates a perspective view of one potential embodiment of the disposable toothbrush head product 100 of the present invention attached to a user's finger and being used to clean the teeth 402 and gums of a user 400 in accordance with the disclosed structure. More specifically, during use, the individual 400 uses the toothbrush head 100 adhered on a fingertip 312 of an index finger 310 for cleaning the teeth 402, and other portions of the mouth. The user 400 takes the head 100 towards the mouth 404 and start rubbing the bristles 104, 106 of the head 100 on the teeth 402 in a direction both parallel and perpendicular to the direction of the finger 310, as with a traditional handheld toothbrush. During use, the toothpaste coating 108 on the bristles 104, 106 will be activated and released onto the surface of the user's teeth once coming into contact with the user's saliva and/or water. The toothpaste coating 108 is also released by the scrubbing action of the bristles 104, 106 against the user's teeth 402, thereby facilitating the cleaning of both the front and back side of the teeth 402, and removing unwanted plaque, food particles and other debris. The coating 108 also imparts a desirable flavor to the teeth and mouth, and freshens the user's breath. The bristles 104, 106 are also gentle on the gums. Once the cleaning process is complete, the user 400 removes the toothbrush head 100 from the fingertip 312 and properly discards the same. In this manner, the toothbrush head 100 of the present invention provides the user 400 with a relatively quick, efficient, easy and effective way of cleaning the user's teeth 402 on the go.

Figure 5:
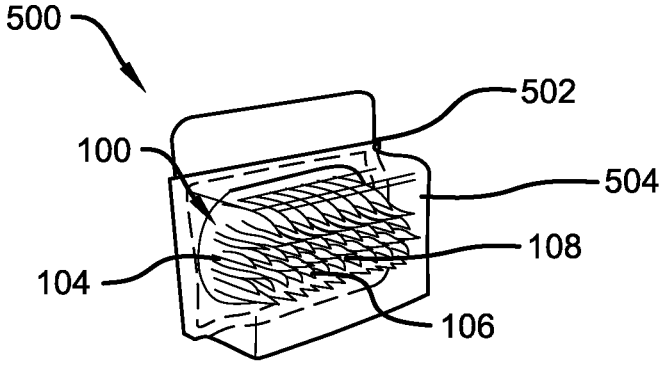
FIG. 5 illustrates a perspective view of one potential embodiment of the disposable toothbrush head product of the present invention sealed in a packaging and ready for use in accordance with the disclosed structure.

FIG. 5 illustrates a perspective view of one potential embodiment of the disposable toothbrush head product 100 of the present invention sealed in a packaging and ready for use in accordance with the disclosed structure. More specifically, the toothbrush head product 100 of the present invention is manufactured and sold with a toothpaste, gel or other coating or solution 108 applied to bristles 106 and/or 104, and with a cover 504 providing an airtight seal 502 around the head 100. The airtight seal 502 and the cover 504 allows the toothpaste or coating 108 to not dissipate over a reasonable shelf life of the product. The cover 504 is wide enough such that the tip of the coated bristles does not touch the cover 504, and the cover 504 may be of any shape in correspondence to the shape of the head 100. For example, the cover may have any geometric shape such as rectangular, oval, or the like. The individually wrapped disposable toothbrush head 100 of the present invention can be easily sold through convenience stores, supermarkets, stationery, vending machines and the like, and can be distributed for anytime, anywhere use. The package may also be sold as a larger package of disposable heads 100, which can be separated from one another for individual use. Individually wrapped disposable toothbrush head product 500 of the present invention is compact in size, lightweight, and can be carried easily in a pocket or in a purse by the user. The device is also hygienic, aesthetically pleasing and cost effective.

Figure 6A:
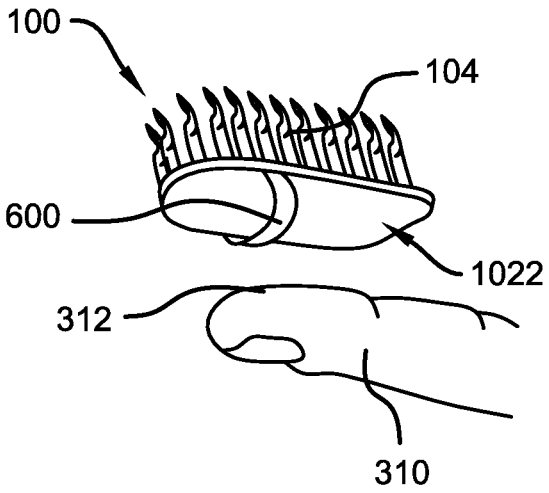
FIG. 6*a* illustrates a perspective view of an alternative embodiment of the disposable toothbrush head product of the present invention having a ring like structure for attachment to a user's finger in accordance with the disclosed structure.
Figure 6B:
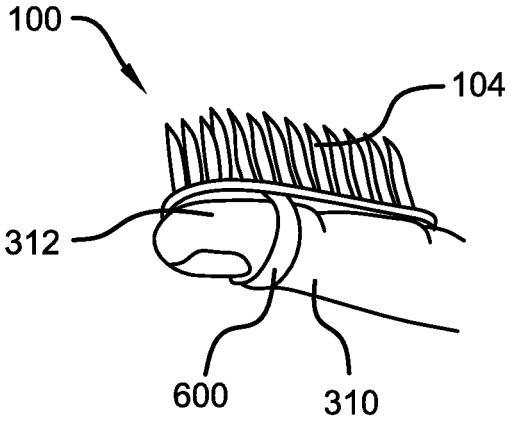
FIG. 6*b* illustrates a perspective view of an alternative embodiment of the disposable toothbrush head product of the present invention having a ring like structure and attached to a user's finger in accordance with the disclosed structure.

FIG. 6*a* illustrates a perspective view of an alternative embodiment of the disposable toothbrush head product 100 of the present invention having a ring like structure 600 for attachment to a user's finger 310, and FIG. 6*b* illustrates a perspective view of the alternative embodiment of the disposable toothbrush head product 100 attached to a user's finger 310 in accordance with the disclosed structure. More specifically, the finger ring 600 is attached to an exterior surface 1022 of the base 102 of the toothbrush head 100. The finger ring 600 may be of a standard size, a predetermined user size, or may be adjustable in size to easily fit any finger size of the user. Further, the finger ring 600 structure can be made of plastic, paper, paperboard or any other similar light weight and durable material, and which is flexible to accommodate different sizes of fingers. The finger ring 600 of the toothbrush head 100 is worn like a normal ring on a finger 310 of the user, such that the base 102 of the toothbrush head 100 sits on a fingertip 312. The toothbrush head 100 is then inserted into the mouth of the user and moved around the teeth and other mouth areas for cleaning the teeth and gums, and removing plaque, food particles and other debris using the bristles 104, 106. Additionally, the finger ring 600 or adhesive strips 302 used to hold the toothbrush head 100 to the finger 310 are generally, centrally disposed on the surface of the toothbrush head to effectively balance the head on the finger while using the toothbrush head 100.

The disposable toothbrush head product 100 of the present invention may be manufactured in a plain white color, or in a variety of different colors, patterns, or decorative prints. The decorative prints could be available in various themes and geometrical shapes such as lines, crosses, rectangles, triangles or sinusoidal lines, sports, logos, designs or a combination of any of these patterns. Further, a customized or personalized print, such as a user name and the like, could also be available on disposable toothbrush head product 100.

In accordance with some embodiments, all of the components of the toothbrush head 100 of the present invention can be made from environment-friendly materials, such as recyclable or biodegradable materials. Examples of biodegradable materials that could be used in accordance with embodiments of the present invention include, but are not limited to, biodegradable plastic, wood, bamboo, polyester, rayon fibers, polyurethane, resins, natural rubbers and nylon.

The toothbrush head 100 of present invention is not limited to any particular size or any particular color. In some embodiments, an intended user and/or use may define a particular design and the appropriate size of the toothbrush head 100. For example, the toothbrush head 100 for cleaning a child's teeth would generally have a smaller size than a toothbrush head for cleaning an adult's teeth.

The disposable toothbrush head 100 of present invention as shown in FIG. 5 may be packaged in toothbrush head container packages that may contain 10, 25, 50, 100 or 200 (or any number as desired by the user) individual heads. In addition, travel sized packages may also be available having a reduced number of heads ranging from 5 to 25 heads per package. The packages may be further segmented into different sized toothbrush heads 100. For example, a family package may have toothbrush heads 100 sized for adults, pre-teens, children and infants. Further, the individual toothbrush heads 100 are hygienically stored in the wrapped package 500. The disposable toothbrush head 100 of the present invention promotes more frequent cleaning of the teeth on the go and away from home, thereby resulting in better overall oral hygiene for the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "disposable toothbrush head", "toothbrush head", "head" and "cleaning head" are interchangeable and refer to the disposable toothbrush head 100 of the present invention.

Notwithstanding the forgoing, the disposable toothbrush head 100 of the present invention can be of any suitable size and configuration as is known in the art without affecting the overall concept of the invention, provided that it accomplishes the above stated objectives. One of ordinary skill in the art will appreciate that the size, configuration and material of the disposable toothbrush head as shown in the FIGS. are for illustrative purposes only, and that many other sizes of the disposable toothbrush head 100 are well within the scope of the present disclosure. Although the dimensions of the disposable toothbrush head 100 are important design parameters for user convenience, the disposable toothbrush head 100 may be of any size that ensures optimal performance during use and/or that suits user need and/or preference. It is further contemplated that a single cleaning head 100 of the present invention may have varying dimensions, thereby allowing the user to choose a particular configuration and size for a specific application. The possibilities are endless.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A package containing a disposable toothbrush head, comprising;

at least one sealed package enclosure sized and configured to hold a toothbrush head;

the toothbrush head having a length and a width with the length being greater than the width, a first surface and a second surface, with the first surface having a plurality of bristles and the second surface having a finger attachment means;

a solution provided on at least some of the plurality of bristles; and wherein the plurality of bristles is further comprised of a first set of helically shaped tip bristles defining a perimeter of the toothbrush head and a second set of crisscross shaped bristles provided in an interior area of the toothbrush head, and further wherein the first set of helically shaped tip bristles are longer than the second set of crisscross shaped bristles; and wherein the toothbrush head is biodegradable.

2. A package as recited in claim 1, wherein there are a plurality of sealed package enclosures with each enclosure having a single personal use toothbrush head.

3. A package as recited in claim 1, wherein the finger attachment means is one of an adhesive attachment, a physical loop or an adjustable clamp.

4. A package as recited in claim 2, wherein the plurality of packages comprises a plurality of different sizes of toothbrush heads for adults, pre-teens, children and infants.

5. A package as recited in claim 4, wherein the toothbrush head for adults ranges in length from 19 mm to 50 mm and has a width ranging from 25.4 mm to 12.7 mm, for children aged 0-2, the toothbrush head is at least 15 mm, for children 2-6 the toothbrush head size is at least 19 mm, for children 6-12 the toothbrush head size is at least 22 mm.

6. A package as recited in claim 1, wherein the first set of bristles is between 1 to 3 mm taller than the second set of bristles.

* * * * *